US005358465A

United States Patent [19]

Poulton

[11] Patent Number: 5,358,465

[45] Date of Patent: Oct. 25, 1994

[54] BAG FOLDER

[75] Inventor: Barrie A. Poulton, Cheltenham, England

[73] Assignee: Flomat Limited, Derbyshire, England

[21] Appl. No.: 33,578

[22] Filed: Mar. 18, 1993

[30] Foreign Application Priority Data

Mar. 25, 1992 [GB] United Kingdom ..... 9206501

[51] Int. Cl.[5] ..... B65H 18/00; B65H 54/00; B65H 45/04

[52] U.S. Cl. ..... 493/462; 493/480

[58] Field of Search ..... 493/405, 406, 454, 455, 493/460, 480, 461, 462; 242/74, 74.1, 74.2, 61; 270/20.1, 32, 41, 45

[56] References Cited

U.S. PATENT DOCUMENTS

| | | | |
|---|---|---|---|
| 835,601 | 11/1906 | Cox | 242/61 |
| 1,146,364 | 9/1914 | Steely | 242/61 |
| 1,174,039 | 3/1916 | Bardet | 493/405 |
| 4,248,414 | 2/1981 | Rovin | 493/416 |
| 4,403,981 | 9/1983 | Wuthrich | 493/419 |
| 4,900,002 | 2/1990 | Zechner | 493/405 |

*Primary Examiner*—Jack W. Lavinder
*Attorney, Agent, or Firm*—Charles J. Brown

[57] ABSTRACT

There is disclosed a machine for folding bags comprising a spool with which one end of a bag can be engaged, means for rotating the spool and means for constraining the bag to be wound onto the spool as it is rotated.

5 Claims, 2 Drawing Sheets

BAG FOLDER

This invention concerns a machine for folding intermediate bulk containers in the form of large bags used for the transport of powdered, granulated or other particulate solid materials.

Such containers will be referred to hereinafter simply as "bags".

Bags are frequently intended for re-use and are returned from the sites where they are emptied to the sites where they are filled. When they have been emptied they are filled with air and very bulky and it is necessary to squeeze the air from them and fold them up into conveniently sized packages which can be baled for their return journeys. Such packaging is equally desirable if the bags are to be transported for disposal.

Generally operators fold the bags, which can be 2 m in length by placing them on the floor and manipulating them with hands and feet. Aside from the generally inconvenient and time-consuming nature of this operation, residual particulate material adhering to the bags is released into the atmosphere and the outsides of the bags can become grossly contaminated.

It is an object of the present invention to provide a machine for folding bags and which eliminates to a substantial extent the problems aforesaid.

According to the present invention there is provided a machine for folding bags comprising a spool with which one end of a bag can be engaged, means for rotating the spool and means for constraining the bag to be wound onto the spool as it is rotated.

The spool may be shaped so that the wound bag is in the shape of a flat package.

The constraining means may comprise an arcuate member such as a rail spaced from the envelope described by the spool as it is rotated.

Guide means comprised by spaced longitudinal rails arranged in a horizontal plane may provide a bed upon which a bag may be laid and from which it is drawn as it is wound onto the spool.

The base of the machine may comprise one or more hoppers to collect any particulate material released by the bag whilst it is manipulated by the machine.

Suction extraction means may be connected with the base of the or each hopper.

The invention will be further apparent from the following description, with reference to the several figures of the accompanying drawings, which show, by way of example only one form of bag folding machine embodying same.

Figure 1:
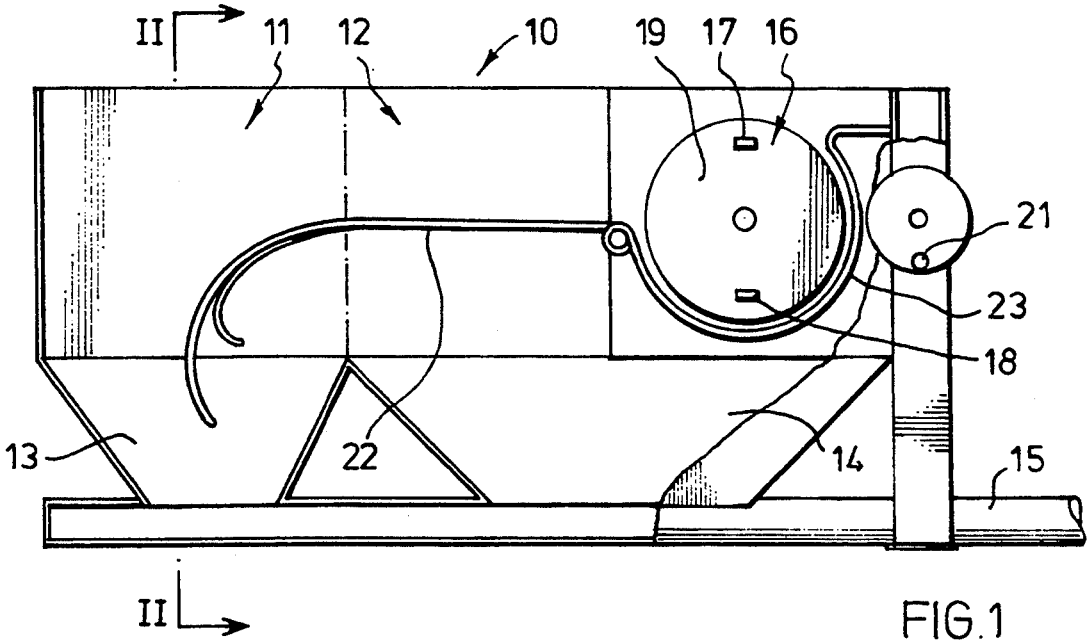
FIG. 1 shows a longitudinal cross-section through the machine on the line I—I of FIG. 2.
Figure 2:
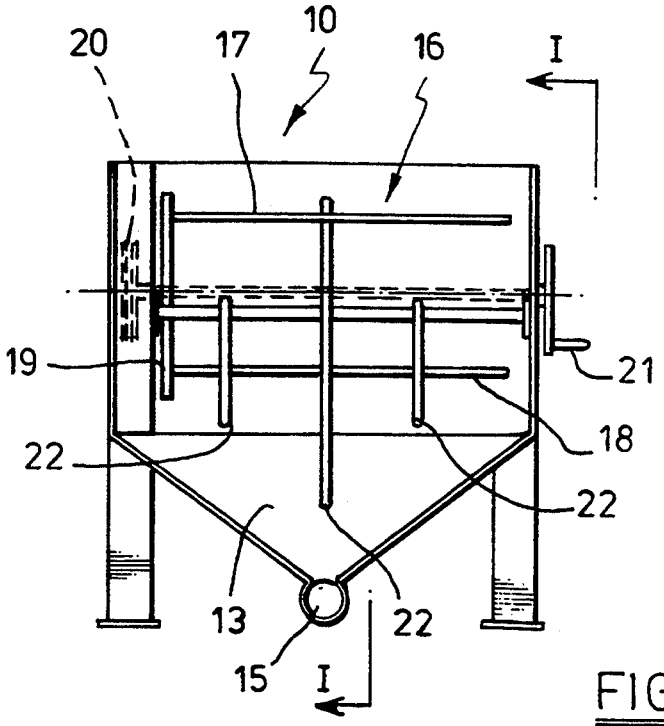
FIG. 2 shows a transverse cross-section through the machine on the line II—II of FIG. 1.
Figure 3:
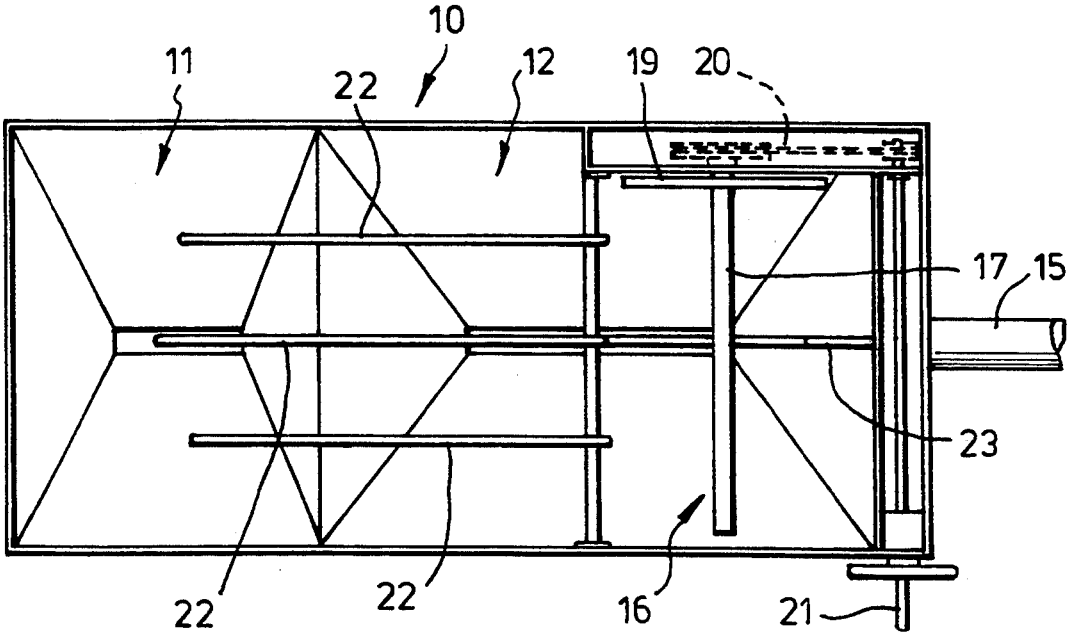
FIG. 3 shows a plan view of the machine.

Referring now to the drawings it will be seen that the machine comprises an open-topped casing generally indicated at 10 and consisting of two sections 11 and 12 arranged end-to-end each having a base in the form of a hopper 13 and 14 respectively from which collected materials can be extracted by a suction line 15.

At one end of the casing is a spool 16 comprised by a pair of diametrically spaced tines 17 and 18 extending horizontally from a circular plate 19 which is mounted for rotation about its centre by means of a chain drive 20 connected with a winding handle 21.

Three transversely spaced rails 22 extend generally upwardly from the end of the casing 10 remote from the spool and then horizontally towards the spool 16 and form a bed upon which a bag to be folded may be laid.

The central rail 22 has an arcuate extension 23 spaced from the envelope described by the tines 17 and 18 as the spool 16 is rotated.

In use, a bag is laid within the casing on the rails 22 and one of its ends is engaged with the spool 16 which is rotated by means of the handle 21. The bag is constrained by the extension 23 to be wound tightly around the tines 17 and to form a generally flat package, which may upon completion be slid from the tines for packaging.

Any particulate material released from the bag into the hoppers 13 and 14 is collected into the line 15 reducing release into the environment.

It will be appreciated that it is not intended to limit the invention to the above example only, many variations, such as might readily occur to one skilled in the art, being possible, without departing from the scope thereof.

Thus the machine may be equipped with automatic means to discharge the wound up bags directly into such as a baling machine.

The spool may be at an elevated position whereby the bag is arranged vertically rather than horizontally before being being taken onto the spool.

I claim:

1. A machine for folding air-containing bulky emptied bags comprising a) a spool rotatable about an axis, b) a pair of diametrically opposed tines on the spool, c) means for rotating the spool in one direction, d) constraining means spaced from an envelope described by the tines as the spool is rotated for causing the bag to wind tightly around the tines in the form of a generally flat package which is slidable from the tines, and e) at least one hopper in a base of the machine for collecting any particulate material released by the bag during operation of the machine.

2. A machine for folding bags according to claim 1 which includes suction means associated with the hopper for extracting any collected particulate material.

3. A machine for folding bags according to claim 1 wherein the constraining means comprises a fixed curved rail spaced from said envelope descried by the tines as the spool is rotated.

4. A machine for folding bags according to claim 1 which includes guide means comprising spaced longitudinal rails arranged in a horizontal plane to provide a bed upon which said bag may be laid and from which it is drawn as it is wound onto the spool.

5. A machine for folding air-containing bulky emptied bags comprising a) a spool rotatable about an axis, b) a single pair of diametrically opposed parallel tines on the spool, c) means for rotating the spool in one direction, d) arcuate means comprising a fixed curved rail spaced from an envelope described by the tines as the spool is rotated for causing the bag to wind tightly around the tines in the form of a generally flat package which is slidable from the tines, e) at least one hopper in a base of the machine for collecting any particulate material released by the bag during operation of the machine, and f) suction means associated with the hopper for extracting any collected particulate material.

* * * * *